US009388574B2

(12) United States Patent
Ryan

(10) Patent No.: US 9,388,574 B2
(45) Date of Patent: Jul. 12, 2016

(54) STAY-IN-PLACE CONCRETE FORM CONNECTOR

(71) Applicant: Kevin Patrick Ryan, Zionsville, PA (US)

(72) Inventor: Kevin Patrick Ryan, Zionsville, PA (US)

(73) Assignee: Kevin P. Ryan, Zionsville, PA (US)

( * ) Notice: Subject to any disclaimer, the term of this patent is extended or adjusted under 35 U.S.C. 154(b) by 0 days.

(21) Appl. No.: 14/569,740

(22) Filed: Dec. 14, 2014

(65) Prior Publication Data

US 2016/0168849 A1 Jun. 16, 2016

(51) Int. Cl.

| | |
|---|---|
| ***E04B 1/74*** | (2006.01) |
| ***E04B 2/86*** | (2006.01) |
| ***E04G 9/10*** | (2006.01) |
| ***E04G 11/06*** | (2006.01) |
| ***E04G 17/075*** | (2006.01) |
| *E04G 17/06* | (2006.01) |

(52) U.S. Cl.

CPC ..... *E04B 2/8617* (2013.01); *E04B 2/8641* (2013.01); *E04G 9/10* (2013.01); *E04G 11/06* (2013.01); *E04G 17/0758* (2013.01); *E04G 2017/0638* (2013.01)

(58) Field of Classification Search

CPC ..... E04C 1/40; E04B 2/86; E04B 2/8617; E04B 2/8641; E04G 21/02; E04G 11/06; E04G 17/0758; E04G 9/10; E04G 2017/0638

USPC ..... 52/404.2, 309.15, 426

See application file for complete search history.

(56) References Cited

U.S. PATENT DOCUMENTS

| | | | | | |
|---|---|---|---|---|---|
| 2,029,082 | A * | 1/1936 | Odam | 52/275 |
| 3,292,893 | A * | 12/1966 | Williams | 249/42 |
| 4,698,947 | A * | 10/1987 | McKay | 52/309.12 |
| 4,730,422 | A * | 3/1988 | Young | 52/105 |
| 4,750,308 | A * | 6/1988 | McKay | 52/379 |
| 4,765,109 | A * | 8/1988 | Boeshart | 52/426 |
| 5,107,648 | A * | 4/1992 | Roby | 52/309.12 |
| 5,224,314 | A * | 7/1993 | Chen | 52/308 |
| 5,430,983 | A * | 7/1995 | Taipalensuu | 52/233 |
| 6,151,856 | A * | 11/2000 | Shimonohara | 52/426 |
| 6,230,462 | B1 * | 5/2001 | Beliveau | 52/426 |
| 6,293,067 | B1 * | 9/2001 | Meendering | 52/426 |
| 6,438,918 | B2 * | 8/2002 | Moore et al. | 52/426 |
| 7,347,029 | B2 * | 3/2008 | Wostal et al. | 52/426 |
| 8,424,835 | B2 * | 4/2013 | McDonagh | 249/34 |
| 2013/0269275 | A1 * | 10/2013 | Ryan | 52/426 |

* cited by examiner

*Primary Examiner* — Basil Katcheves

(57) ABSTRACT

A stay-in-place concrete form includes masonry shells layered with rigid insulation tied with plastic cross tie assemblies. The masonry shells can be connected with plastic dovetail connectors that compensate for the variation in height of the shells. This allows for the shells, together with the connectors, to be a consistent height and allows for dry stacking. This dry stacking method can result in labor time and training savings over conventional masonry mortar construction.

7 Claims, 6 Drawing Sheets

STAY-IN-PLACE CONCRETE FORM CONNECTOR

CROSS-REFERENCE TO RELATED APPLICATION

This application claims the benefit of priority of U.S. provisional application No. 61/625,447, filed Apr. 17, 2012, the contents of which are herein incorporated by reference and U.S. Non-provisional application Ser. No. 14/039,973, filed Jul. 14, 2014.

FIELD OF THE INVENTION

The present invention relates to concrete forms and, more particularly, to a masonry connector that positions opposing masonry shells in a level and plumb manor for use as STAY-IN-PLACE form work.

BACKGROUND OF THE INVENTION

Concrete Masonry Units (CMU) are used in the construction of walls in buildings but have disadvantages that are costly to overcome. Block construction involves stacking CMU blocks in a grid pattern (typically 16 inch×8 inch grid) to form a wall. CMU is manufactured in a molding process that results in blocks that can vary in size plus or minus ⅛ inch within the height of a block.

Dry-stacking blocks with these inconsistencies in height would result in a wall that is out of plumb and level. The masonry industry has solved this problem by manufacturing CMU blocks to a size (typically 15⅝ inch×7⅝ inch) slightly smaller than their intended grid size. These masonry blocks are then stacked with a bed of mortar (typically ⅜ inch), to compensate for the smaller size, keeping the wall construction in line with the grid pattern established.

A skilled mason lays mortar on the previous course of CMU blocks thicker than required, stacks the next course of block on top of the mortar and taps on the top of the block until he compresses the mortar down and out so that the combination of the block and the mortar lines up with the grid pattern.

This process results in mortar thickness that varies to compensate for the inconsistent heights of plus or minus ⅛ inch in CMU masonry units and allows for the construction of plumb and level masonry walls.

Using STAY-IN-PLACE concrete forms constructed of concrete masonry shells with plastic web members is an alternative wall construction method that has been limited due to high labor cost associated with mortaring shells in place.

The present invention is a plastic connector that enables masonry shells of inconsistent dimensions with preformed channels to be snapped together while maintaining a gap of variable thickness between the shells such that the masonry shells and the gap fall within a predetermined grid pattern. The connectors perform the function of mortar joints in masonry construction while reducing the time, labor and skill required by eliminating mortaring joints as the masonry is set.

Mortar also has a set time that requires a waiting period before moving on to the next row of masonry shells. The present invention's plastic connectors have no set time. Masonry shells can be snapped together to form the opposing walls of a stay in place concrete form with no wait time, less labor and skill, while maintaining a predetermined grid pattern.

The connectors are also configured to accept plastic cross ties. Cross ties are required in concrete form work to restrain poured in place concrete between two opposing form walls.

The viscosity of the poured in place concrete can be controlled such that the uncured concrete will not leak out of the small variable gaps maintained by the plastic connector. Once the poured in place concrete has been cured, the gaps between the masonry shells can be left open, can be filled with caulk, can be filled with adhesive, or can be filled with mortar.

Prior art does not properly address using masonry shells of variable dimensions as the walls of concrete form work. Using shells of variable dimensions without compensating for this variation will result in walls that are out of plumb and level. Prior art teaches stacking and snapping together shells with consistent dimensions. Prior art teaches using mortar joints or adhesives or caulk to compensate for variations in shell sizes. The present invention teaches how to snap shells of inconsistent dimensions together with a plastic connector that compensates for the inconsistencies incrementally with each course of shells.

Conventional stay-in-place masonry forms come in the form of blocks that needed to be mortared into place, the same as normal masonry construction.

As can be seen, there is a need for an improved stay-in-place concrete form connector that allows masonry shell of variable dimensions to be dry stacked to form the walls of concrete form work.

SUMMARY OF THE INVENTION

In one aspect of the present invention, a method of connecting concrete masonry shells together with plastic connectors that adjusts the height of the shells to a consistent height for use in a stay in place concrete form.

The plastic connectors are configured to fit tightly in a channel formed in the masonry shells. The friction from the tight fit of the assembly with the channel formed in the masonry shell unit allows for the height of the shell unit and the plastic assembly combined to match a predetermined block coursing. Force is applied to the assembly (such as tapping with a rubber mallet) reducing the height of the assembly by sliding a tongue in the connector into a channel in the shell. The force is discontinued when the assembly meets the height requirements. The friction resistance between the tongue (a dovetail dowel in one embodiment) and the channel must be great enough to hold up the weight of the masonry shell but small enough to allow movement when the external force (tapping rubber mallet) is applied.

The plastic connector would also have an indentation (hole) formed as part of the connector to accept a geometric plastic cross tie of uniform shape. The plastic cross ties would connect an interior and exterior shell assembly together the combination of which will act as a stay in place concrete form.

In one embodiment, the plastic cross ties consist of ½ inch diameter pvc pipe. The pvc plastic cross ties can be cut to any length. The thickness of the concrete wall formed inside of this cavity is determined by changing the length of the plastic cross ties to match the desired concrete wall thickness plus the desired insulation thickness. The plastic cross ties fit into a hole formed in the connector that is part of the shell assembly of consistent height on both the exterior and the interior. The plastic cross tie is either glued or screwed after it is inserted into the plastic connector on both sides.

Sheets of rigid insulation can be placed on one or both interior faces of the masonry shells before attaching the ½ inch diameter pvc plastic cross ties. The plastic cross ties are then pressed through the rigid insulation as the cross ties are inserted into the plastic connectors on the opposing wall assemblies of the stay in place concrete form.

In one embodiment, the plastic connectors have a wedge shim protrusion to act as a guide to set the height of the gap between the stacked masonry shells. The wedge shim would be operable by expanding the thickness of the shim. The wedges shim would spread apart or move together by threading a screw into the wedge shim as required to obtain the proper gap height.

In one embodiment, the channels formed in the masonry shells at regular intervals to accept the plastic connectors are dovetail shaped channels and the plastic connectors are dovetail shaped dowels of a predetermined height to match the shape of the masonry shell channels. Half of the height of the dovetail shaped dowel is embedded in the dovetail channel formed in a masonry shell. The dovetail shaped dowels are placed in pairs in the top of a pair of channels formed in a masonry shell. The second half of the height of the dovetail shaped dowels extends above the masonry shell. A second masonry shell with matching dovetail shaped channels then slides over the extended portion of the dovetail shaped dowels. The dovetail shaped dowels are slightly larger than the channels in the masonry shell such that force is required to deform the dovetail shaped dowels into the channel. Through friction between the dowels and the channels, the masonry shells are locked in place to the pair of dowels and in turn the shells are also connected together by the dowels. This allows for multiple levels of masonry shells to be connected together, stacked one on top of another, to form the walls of stay in place form work.

In one embodiment, the lower half of the dovetail shaped dowel has protruding friction teeth. The teeth extend outside of the dovetail shape of the dowel such that the dovetail dowel will not slide into the masonry shell dovetail channel. A large force (such as hammering the top of the dovetail dowel with a rubber mallet) is required to deform the friction teeth and force the lower half of the dovetail shaped dowel into the top of the masonry shell dovetail channel locking the dovetail dowel in place through friction.

In one embodiment, the upper half of the dovetail shaped dowel has a hole in the side of the dowel to accept attachment of a ½ inch pvc pipe cross tie. The top of the dowel has a wedge shaped pilot hole. One function of the pilot hole is to guide a screw through the top of the dowel and into the pvc pipe cross tie to connect the two separate parts together. The connector and the cross tie are connected together before the next masonry shell is stacked onto the upper half of the plastic connector's dovetail dowel.

In one embodiment, a second masonry shell with dovetail shaped channels slides down onto the upper half of the pair of dovetail shaped dowels extending up from the masonry shell described two paragraphs above. Only light force is required to force the masonry shells onto the dowels. The height of the masonry shell is adjusted by the wedge shims described above. This adjustment results in a plumb and level installation. A second function of the wedge shaped pilot hole is to expand the upper half of the dovetail dowel once the dowel is properly positioned to lock the upper half of the dovetail dowel in place inside of the dovetail channel. The same screw that attaches the pvc plastic cross tie to the dovetail dowel is screwed in further until the wider head of the screw enters the wedge pilot hole. As the wider head of the screw enters the wedge the top half of the dovetail dowel expands locking the dovetail dowel in place through friction inside of the dovetail channel.

These steps are repeated stacking one masonry shell on top of another masonry shell until the required height of concrete form work is achieved.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a stay-in-place concrete form connector including masonry shells layered with rigid insulation tied with plastic cross ties. The masonry shells can be adjusted with plastic connectors that compensate for the variation in height of the shells. This allows for the shells, together with the connectors, to be a consistent height and allows for dry stacking. This dry stacking method can result in labor time and training savings over conventional masonry mortar construction.

Conventional formed concrete walls do not have a desirable appearance and require additional steps to insulate and finish when used as a structural wall in buildings. The present invention solves this problem.

Stay-in-place forms eliminate the need to strip off temporary forms for concrete wall construction. Adding insulation to the concrete wall in a later step is not required as insulation can be integrated into the stay-in-place form. The stay-in-place form can act as an exterior and/or interior wall finish that is desirable to the end user.

Prior to the present invention, stay-in-place block forms came in the form of blocks that needed to be mortared into place, the same as normal masonry construction. The present invention eliminates the need to mortar joints, allows for up to two layers of rigid insulation, adding to the insulation value of the assembly while also improving moisture resistance, and sound deadening characteristics.

The present invention can be assembled in the field which allows for this assembly to be constructed around construction obstacles such as vertical reinforcement bars in concrete and/or embedded utility piping.

Concrete wall forms consist of two vertical surfaces connected by ties spaced at close intervals so that when concrete is poured between the two surfaces they are held in place by equal and opposite forces induced by the wet concrete. The plastic connector of the present invention makes it practical and affordable to use masonry shells of inconsistent dimensions as those vertical surfaces.

Figure 1:
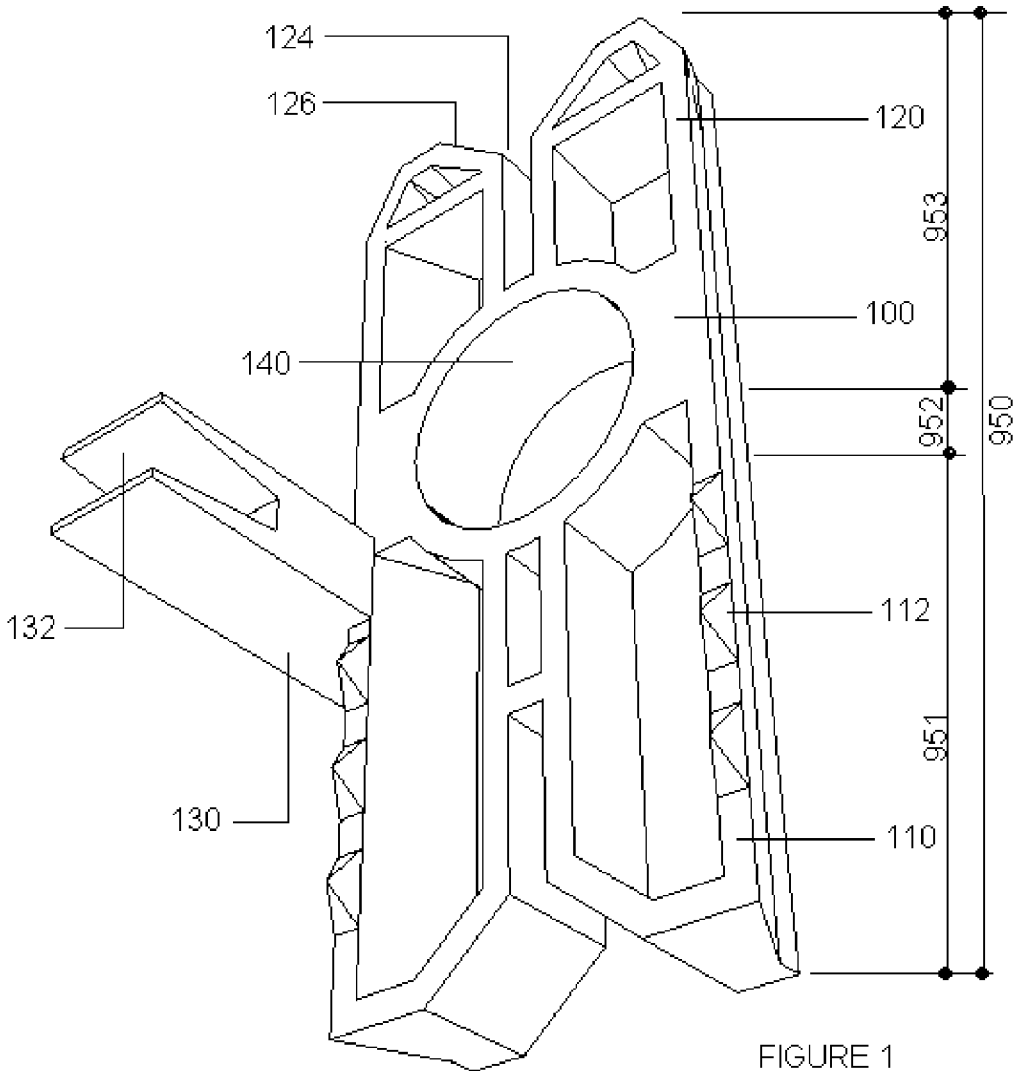
FIG. 1 is an side view of the plastic dovetail dowel connector (100) according to an exemplary embodiment of the present invention.

Referring now to the Figures, a split plate metal mold with injection ports is manufactured to produce injection molded polypropylene parts 100 in the configuration shown in FIG. 1. This plastic part is configured into a dovetail shaped dowel 100 with a web shim guide protrusion 130 and a cross tie hole 140 to receive ½ inch diameter pvc pipe cross ties 400. This configuration is the best currently contemplated configuration for carrying out exemplary embodiments of the invention.

Figure 2:
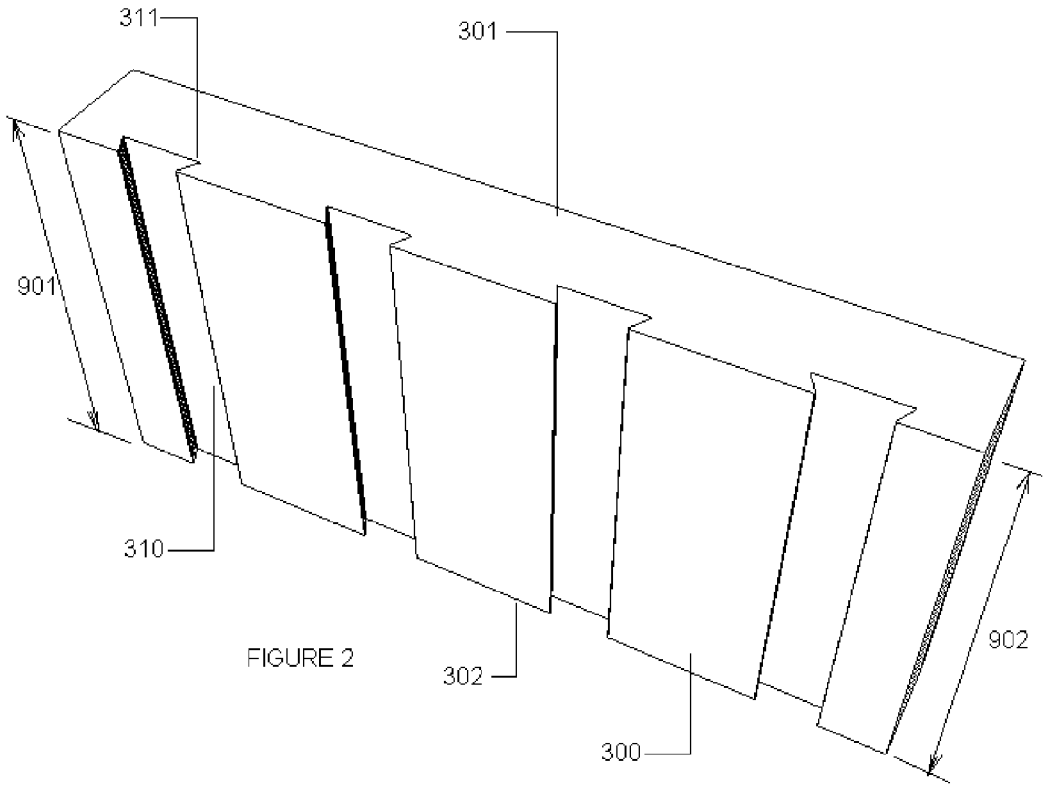
FIG. 2 is a side view of a concrete masonry unit (CMU) shell (300) with dovetail shaped channels molded into it at regular intervals.

The present invention's dovetail shaped dowel 100 act in pairs as a connector to join masonry shells of inconsistent dimensions 300 together for use as stay in place concrete form work. Referring now to FIG. 2, Masonry shells 300 are molded with vertical channels 310 spaced at equal spacings with a dovetail shape 311 that closely matches the shape of the dovetail dowel connector 100. Due to the manufacturing process of concrete masonry units, the top edge 301 and bottom edge 302 of the masonry shell 300 can be uneven. The height of the masonry shell 300 can vary from one shell to the next. The height of the masonry shell 300 can vary within the length of one shell such that the height on the left side of the shell 901 can be ⅛ inch different from the height on the right side of the shell 902.

Figure 4:
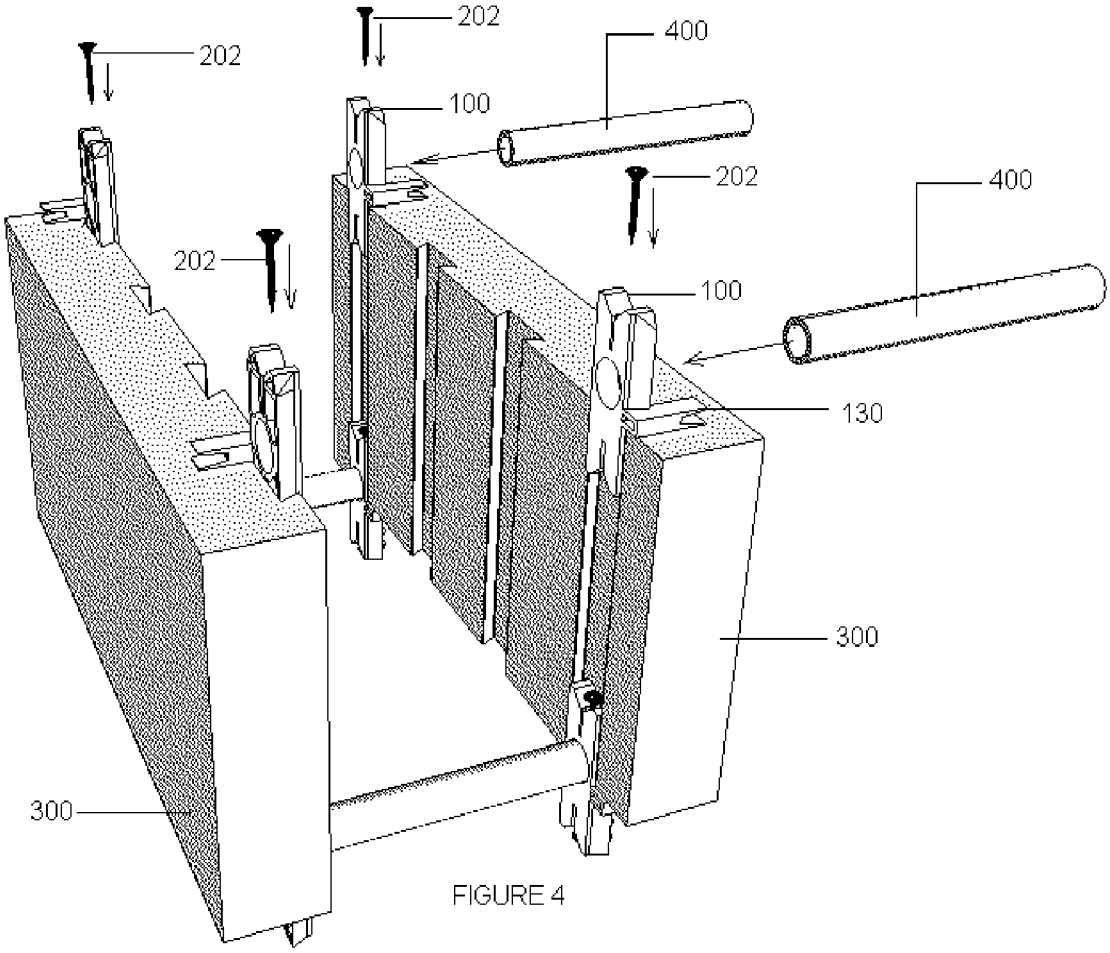
FIG. 4 is a longitudinal view showing insertion of ½ inch diameter plastic pipe cross ties (400) into the plastic dovetail dowel connector (100) and screwing the cross tie to the connector with standard cement board screws (202) according to an exemplary embodiment of the present invention.
Figure 5:
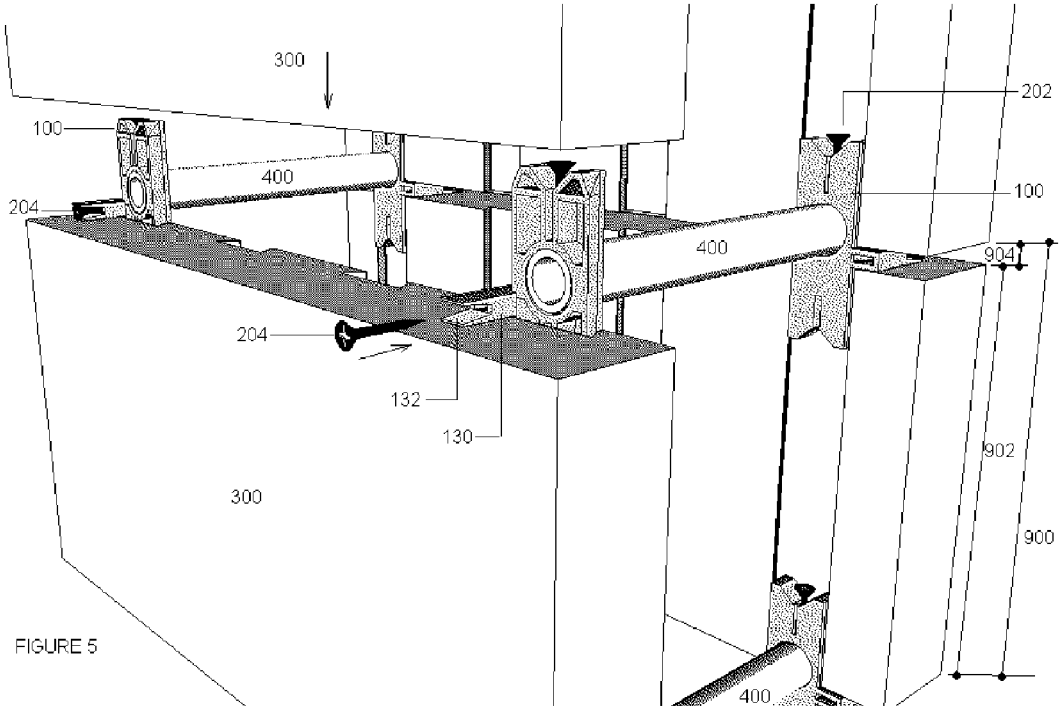
FIG. 5 is an orthogonal view showing a second concrete masonry unit shell (300) being disposed on the upper half of the plastic dovetail dowel connector (100) according to an exemplary embodiment of the present invention.

Dovetail shaped dowel connector 100 shown in FIG. 1 and masonry shell 300 shown in FIG. 2 are the only special configuration parts required to carrying out the exemplary embodiment described here. All other parts are standard parts that can be purchased at any home improvement store. Cement board screw 202 as shown in FIG. 4 to attach the cross ties 400 to the dovetail dowel connector 100 is a standard cement board screw that is identical to a drywall screws except that it has a special coating to resist the corrosive effects of concrete. Cement board screws 204 as shown in FIG. 5 used to expand wedge shims 132 are also standard cement board screws. ½ inch diameter pvc pipe cross ties 400 are standard ½ inch plumbing pvc piping cut to length.

Figure 3:
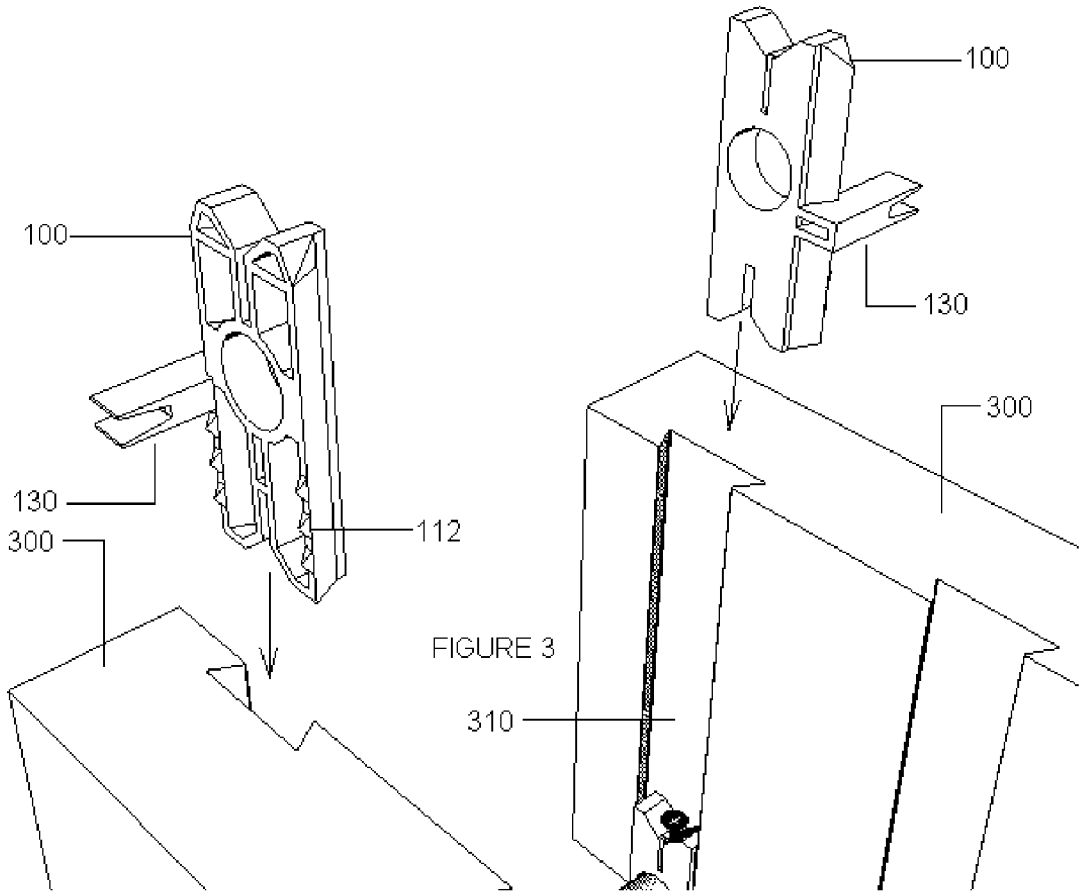
FIG. 3 is a isometric view showing the plastic dovetail dowel connector (100) being disposed on the masonry shells (300) of the concrete form of the present invention.

Referring now to FIG. 3, the bottom half 110 of the dovetail dowel connector 100 is driven into masonry shell 300 in opposing pairs. The dovetail dowel connector has protruding friction teeth 112 that extend beyond the dovetail shape of the dovetail shaped vertical channels 310 such that a large force (such as hitting the top of the connector 100 with a rubber mallet) is required to deform protruding friction teeth 112 and to force dovetail dowel connector 100 into the dovetail shaped vertical channel 310. The dovetail dowel connector 100 is forced into the dovetail shaped vertical channel 310 until the wedge shim protrusion 130 on the dovetail dowel connector 100 comes in contact with the top edge of masonry shell 300. About ½ the length 951 of the dovetail dowel connector's bottom half 110 as shown in FIG. 1 is embedded into masonry shell 300.

Referring now to FIG. 4, the pairs of dovetail dowel connectors 100 are joined together with ½ inch pvc cross ties 400 that are cut to the proper length. As seen in FIG. 1, dovetail dowel connector 100 has a hole 140 formed in the top half 120 of dovetail dowel connector 100 that matches the diameter of the pvc cross tie 400. The pvc cross ties 400 are slid through one dovetail dowel connector 100 across and into the matching pair dovetail dowel connector 100 to form opposing walls of stay in place form work.

If optional insulation is required then sheets of insulation can be placed against one or both interior faces of masonry shells 300. The pvc cross tie 400 is simply pushed through the soft rigid insulation as required to make the connection between the pair of dovetail dowel connectors 100. A pair of cement board screws 202 are driven into the top of dovetail dowel connector 100 through wedge shaped 126 pilot holes 124 and through the pvc cross tie 400 locking the cross tie in place. The head of the cement board screws 202 must not engage the wedge 126 of the wedge shaped pilot hole at his time.

Referring now to FIG. 5, another course of masonry shells 300 can now be stacked on top of the previous course. Light force is required to slide masonry shell 300 with dovetail shaped vertical channel 310 down onto the upper half 120 of a pair of dovetail dowel connectors 100 until the masonry shell 300 rests on top of wedge shim protrusion 130. Wedge shim protrusion 130 has a pair of wedges 132 that expand when the head of a cement board screws 204 is tightened between the wedges 132. Expanding or releasing the wedges 132 adjusts the gap 904 between stacked masonry shells 300 and can be adjusted so that the gap 904 plus the masonry shell height 902 together equals a predetermined grid height 900 (usually 8 inches high). This adjustment is repeated at all 4 corners of the assembly.

Figure 6:
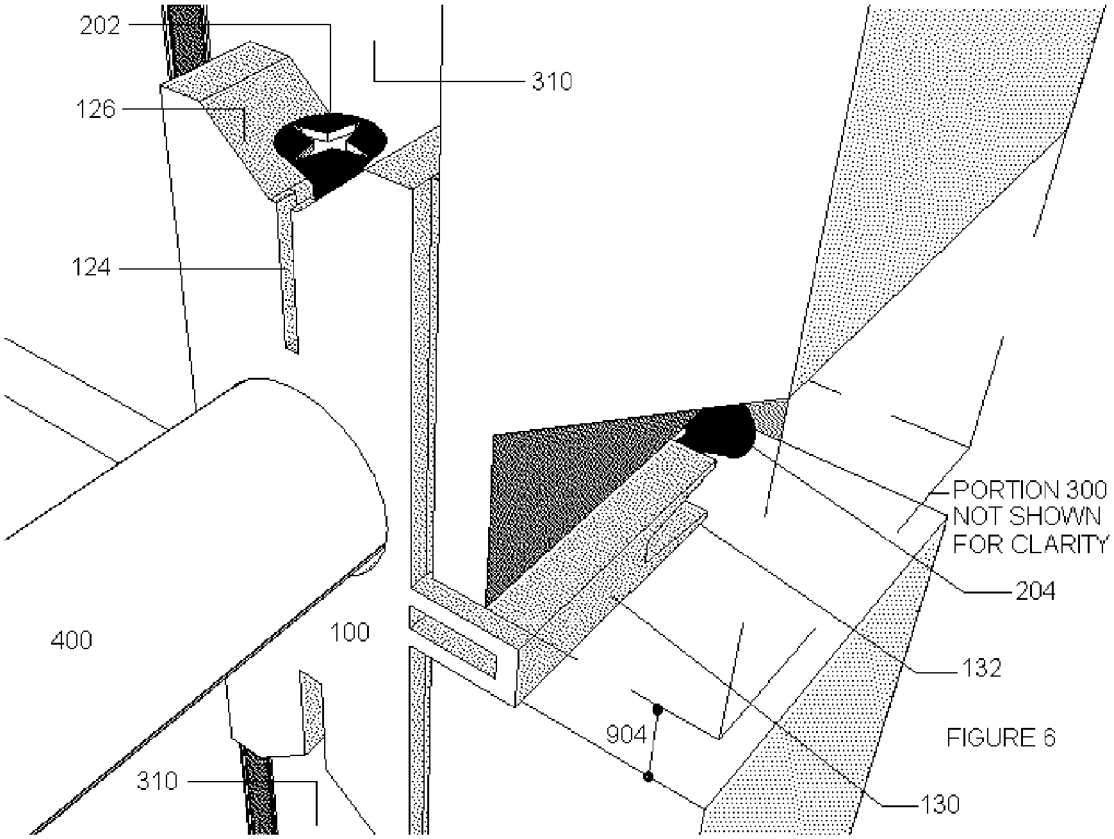
FIG. 6 is a cutaway view showing the function of a wedge shim (130) protrusion extending off of plastic dovetail dowel connector (100) as used to adjust the height of the gap between masonry shells (300) according to an exemplary embodiment of the present invention.

Referring now to FIG. 6, masonry shell 300 is locked into place by engaging cement board screws 202 down into wedge shaped 126 pilot hole 124 causing the top half 120 of dovetail dowel connector to expand. This expansion creates friction forces between the top half 120 of dovetail dowel connector 100 and dovetail shaped vertical channel 310. The masonry shells 300 are now connected together with a pair of dovetail dowel connectors 100. The two opposing walls of the form work are now connected by pvc cross ties 400 that are attached to a pair of dovetail dowel connectors 100. The stacking steps are repeated until the form work reaches the desired height.

It should be understood, of course, that the foregoing relates to exemplary embodiments of the invention and that modification may be made without departing from the spirit and scope of the invention as set forth in the following claims.

What is claimed is:

1. A wall form system comprising:

a pair of parallel, spaced apart form walls, each form wall configured from multiple concrete masonry unit shells that are engaged together at a top edge to a bottom edge to form said walls;

multiple aligned vertical channels formed along a height of the concrete masonry unit shells, each channel having an elongated, tapered width, open slot formed through a wall surface extending into the interior of the shells and facing towards an opposing form wall;

plastic connectors sized and shaped to fit into the vertical channels of the concrete masonry unit shells, each connector extending half its length into a concrete masonry unit shell below, and another half its length extending into a concrete masonry unit shell above, multiple said plastic connectors joining two concrete masonry unit shells together;

ties for interconnecting and immobilizing spaced apart form walls, said ties each comprising a plastic tube, a length of the plastic tube cut to match a width of a space between spaced apart form walls and shaped to fit into an aperture of opposing, aligned plastic connectors, the plastic connectors and plastic tubes configured to be permanently connected by threading a metal connector through adjacent surfaces of the plastic tubes and the plastic connectors;

said plastic connectors formed with an aperture sized and shaped to receive the ties, the plastic connector positioned directly opposite another matching plastic connector of a parallel, spaced apart form wall;

said plastic connectors formed with a horizontal shim tube extending between stacked concrete masonry unit shells, a center of the shim tube sized to engage a tapered head screw;

said shim tube formed with opposing top and bottom wedge extensions which protrude between stacked concrete masonry unit shells, the wedge extensions positioned and sized to adjust a gap between stacked concrete masonry unit shells when the tapered head of the screw contacts the wedge extensions as the screw is threaded into the shim tube.

2. The wall form system of claim 1, wherein the multiple aligned vertical channels formed along a height of the concrete masonry unit shells are dovetail shaped.

3. The wall form system of claim 1, wherein the plastic tubes act as ties between the pair of parallel, spaced apart form walls and are ½" diameter pvc plastic pipe.

4. The wall form system of claim 1, wherein the plastic connectors engage the masonry shell channels through friction teeth extending from sides of the plastic connectors.

5. The wall form system of claim 1, wherein the plastic connectors are locked in place within the vertical channels by a wedging action of a screw inserted into a wedge shaped pilot hole.

6. The wall form system of claim 1, wherein the multiple concrete masonry unit shells are lined with rigid insulation.

7. The wall form system of claim 1, further comprising concrete poured in a central region between the pair of parallel, spaced apart form walls.

* * * * *